US008827421B2

(12) United States Patent
Watanabe

(10) Patent No.: US 8,827,421 B2
(45) Date of Patent: Sep. 9, 2014

(54) MAINTENANCE METHOD FOR FLUID EJECTING APPARATUS AND FLUID EJECTING APPARATUS

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 12/781,079

(22) Filed: May 17, 2010

(65) Prior Publication Data

US 2010/0289850 A1 Nov. 18, 2010

(30) Foreign Application Priority Data

May 18, 2009 (JP) ..... 2009-120230

(51) Int. Cl.
*B41J 2/165* (2006.01)

(52) U.S. Cl.
CPC ..... *B41J 2/16511* (2013.01); *B41J 2/16585* (2013.01); *B41J 2/16532* (2013.01)
USPC ..... 347/32

(58) Field of Classification Search
None
See application file for complete search history.

(56) References Cited

U.S. PATENT DOCUMENTS

| | | | | |
|---|---|---|---|---|
| 2001/0003459 | A1* | 6/2001 | Saijo | 347/32 |
| 2004/0104961 | A1* | 6/2004 | Hashi et al. | 347/29 |
| 2008/0143779 | A1* | 6/2008 | Yoshida | 347/30 |

FOREIGN PATENT DOCUMENTS

| | | |
|---|---|---|
| JP | 2004-009512 | 1/2004 |
| JP | 2005-329551 | 12/2005 |
| JP | 2006-168093 | 6/2006 |
| JP | 2008-221796 | 9/2008 |

* cited by examiner

*Primary Examiner* — Alejandro Valencia
(74) *Attorney, Agent, or Firm* — Workman Nydegger

(57) ABSTRACT

A maintenance method for a fluid ejecting apparatus having a fluid ejecting head which ejects fluid and a fluid reception member which receives the fluid in a predetermined posture, includes changing a posture of the fluid reception member to an inclined posture which is a posture inclined with respect to the predetermined posture; and sucking fluid in the fluid reception member in the inclined posture after changing the posture to the inclined posture.

4 Claims, 8 Drawing Sheets

MAINTENANCE METHOD FOR FLUID EJECTING APPARATUS AND FLUID EJECTING APPARATUS

BACKGROUND

1. Technical Field

The present invention relates to a maintenance method for a fluid ejecting apparatus and the fluid ejecting apparatus.

2. Related Art

For example, an ink jet type recording apparatus is known as a fluid ejecting apparatus which ejects fluid. The ink jet type recording apparatus is an apparatus for recording characters, images, or the like onto a recording medium (medium). Further, the ink jet type recording apparatus has a configuration in which ink (fluid) is selectively ejected onto the recording medium from nozzles provided on a recording head (fluid ejecting head).

In the fluid ejecting apparatus, a maintenance process is periodically performed on the recording head in order to maintain or recover an excellent ejection state. As a specific maintenance process, a process where a cap member (fluid reception member) is opposed to the recording head and ink is flushed (ejected) from the nozzles so as to adjust a meniscus of the nozzles is exemplified.

JP-A-2008-221796 discloses a maintenance method in which a liquid disposal process is executed in order to prevent ink from being overflowed from a cap member for receiving ink flushed from nozzles. In the liquid disposal process, ink stored in the cap member is sucked and discharged when an estimated amount is equal to or higher than a threshold value by comparing the estimated amount with the threshold value. The estimated amount is obtained by adding an amount of ink to be flushed at the time of a subsequent printing process to an amount of ink stored in the cap member. The threshold value is obtained from an acceptable storage amount of ink in the cap member.

However, a problem that ink remains in the cap member arises in the above liquid disposal process. Ink remaining in the cap member without being completely sucked increases in viscosity and is solidified over time. This results in that the ink is firmly fixed in the cap member. This causes problems such as a capping failure and insufficient suction.

SUMMARY

An advantage of some aspects of the invention is to provide a maintenance method for a fluid ejecting apparatus by which ink remaining in a cap member can be reduced and the fluid ejecting apparatus.

According to an aspect of the invention, a maintenance method for a fluid ejecting apparatus having a fluid ejecting head which ejects fluid and a fluid reception member which receives the fluid in a predetermined posture, includes changing a posture of the fluid reception member to an inclined posture which is a posture inclined with respect to the predetermined posture, and sucking fluid in the fluid reception member in the inclined posture after changing the posture to the inclined posture.

In this method, fluid is sucked in a posture inclined with respect to a posture of the fluid reception member for receiving fluid from the fluid ejecting head. By inclining the fluid reception member, fluid at positions where fluid cannot be completely sucked in a posture for receiving the fluid, for example, fluid at corners of the fluid ejecting head is moved and diffused due to own weight of fluid so as to be sucked from the positions. Therefore, ink remaining in the fluid reception member can be reduced.

Further, the maintenance method for the fluid ejecting apparatus according to the aspect of the invention includes changing the posture of the fluid reception member to a second inclined posture which is a posture inclined to the side opposite to the inclined posture with respect to the predetermined posture after the sucking of the fluid and sucking fluid in the fluid reception member in the second inclined posture after changing the posture to the second inclined posture.

By employing such method, fluid is sucked in the posture that the fluid reception member is inclined to the side opposite to the first inclined posture in the aspect of the invention. By inclining the fluid reception member to the opposite side, fluid at positions where ink cannot be completely sucked in the first inclined posture, for example, fluid trapped in a corner portion on the inclined side is moved and diffused to the opposite side so as to be sucked. Therefore, ink remaining in the fluid reception member can be reduced.

Further, the maintenance method for the fluid ejecting apparatus according to the aspect of the invention includes previously sucking fluid in the fluid reception member in the predetermined posture before changing the posture to the inclined posture.

By employing such method, the fluid is previously sucked in a posture for receiving fluid, and then, fluid which has not been completely sucked at this time is sucked by inclining the fluid reception member in the aspect of the invention.

In addition, in the maintenance method for the fluid ejecting apparatus according to the aspect of the invention, a plurality of outlet ports from which the fluid is flown out by the suction are provided at a bottom of the fluid reception member.

In the aspect of the invention, the fluid reception member takes a plurality of inclined postures. Therefore, fluid is sucked from the plurality of outlet ports provided at the bottom of the fluid reception member, thereby improving the suction efficiency.

Further, the maintenance method for the fluid ejecting apparatus according to the aspect of the invention includes setting the outlet port provided at a position which corresponds to a lower side to be in an open state and setting the outlet port provided at a position which corresponds to an upper side to be in a close state based on the posture of the fluid reception member.

By employing such method, the outlet port to be positioned on a lower side is set to be in the open state and the outlet port to be positioned on an upper side is set to be in the close state based on the posture of the fluid reception member. Therefore, the fluid can be efficiently disposed by sucking the fluid from the lower position. Moreover, the outlet port to be positioned on the upper side based on the posture of the fluid reception member is set to be in the close state so as to prevent the outside air from being flown into the fluid reception member from the outlet port. Therefore, reduction in the suction efficiency can be suppressed.

According to another aspect of the invention, a liquid ejecting apparatus having a fluid ejecting head which ejects fluid and a fluid reception member which receives the fluid in a predetermined posture includes a posture change device which changes a posture of the fluid reception member to an inclined posture which is a posture inclined with respect to the predetermined posture, and a suction device which sucks fluid in the fluid reception member in the inclined posture after changing the posture to the inclined posture.

With employing such configuration, in the aspect of the invention, the fluid is sucked in a posture inclined with respect to a posture of the fluid reception member for receiving fluid from the fluid ejecting head. By inclining the fluid reception member, fluid at positions where fluid cannot be completely sucked in a posture for receiving the fluid, for example, fluid at corners of the fluid ejecting head is moved and diffused due to own weight of ink so as to be sucked from the positions.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
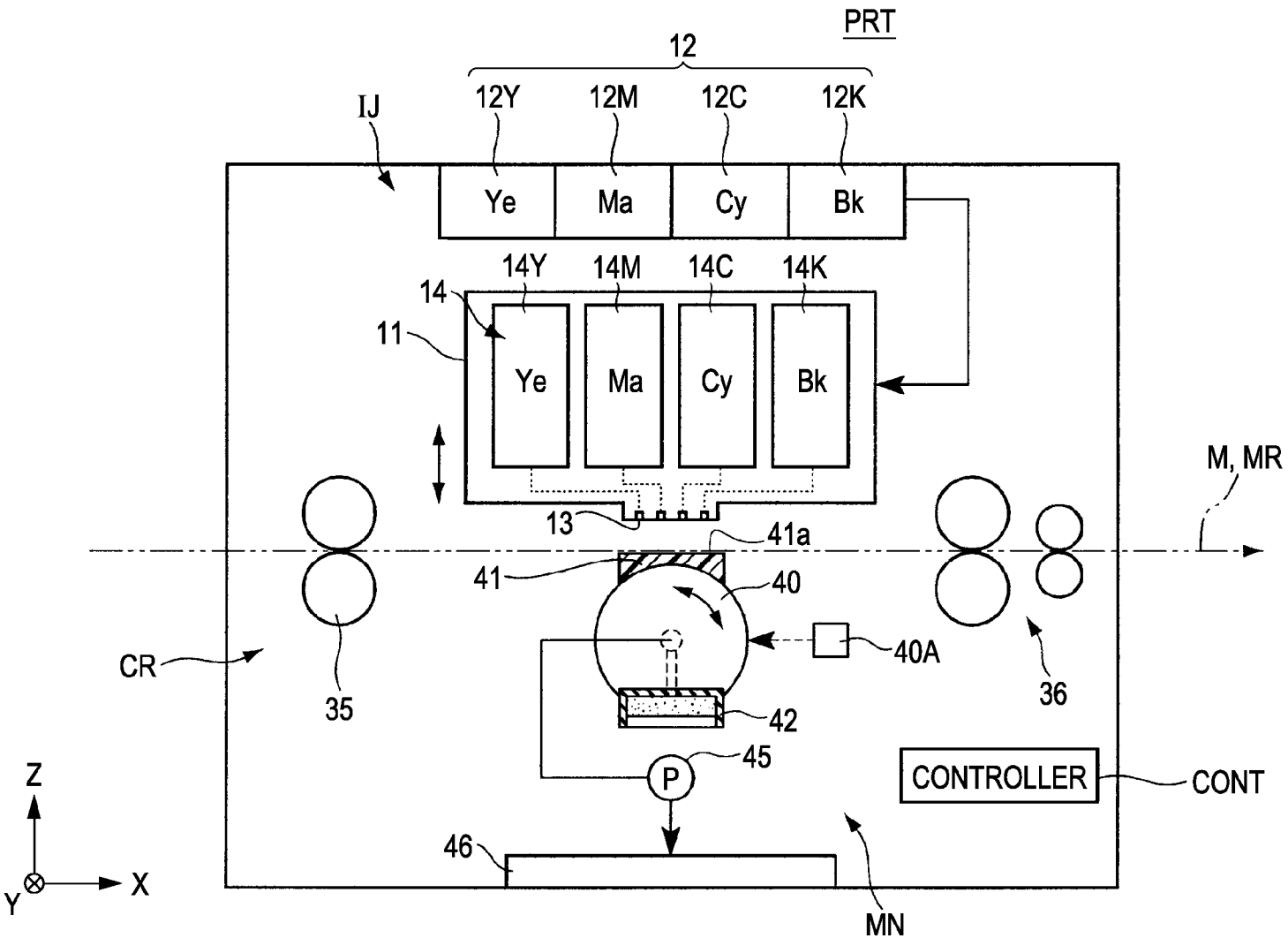
FIG. 1 is a schematic configuration view of an ink jet printer according to a first embodiment of the invention.

Hereinafter, embodiments of a fluid ejecting apparatus according to the invention will be described with reference to drawings. In the drawings used for the following description, scales of members are appropriately changed so as to make the members be recognizable. In the embodiments of the invention, an ink jet type printer (hereinafter, referred to as ink jet printer) is described as an example of the fluid ejecting apparatus according to the invention.

First Embodiment

FIG. 1 is a schematic configuration view of the ink jet printer PRT according to a first embodiment of the invention.

Figure 2:
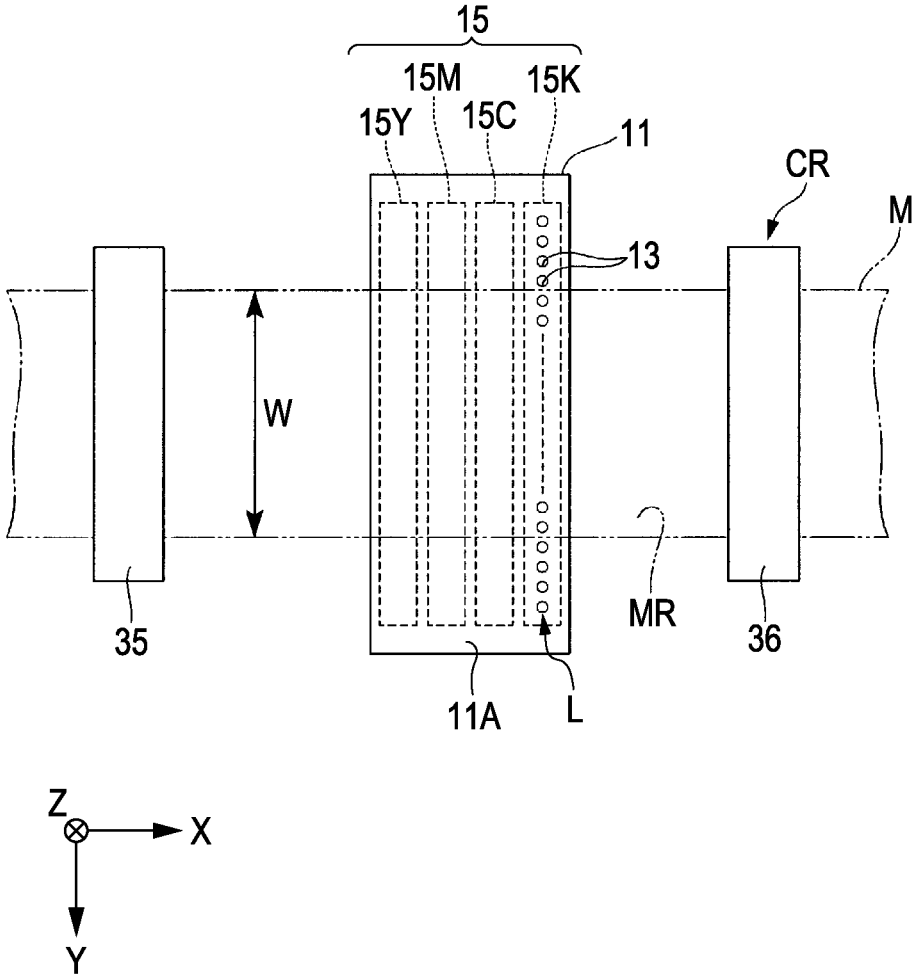
FIG. 2 is a view illustrating a recording head viewed from a side of an ejection plane thereof according to the first embodiment of the invention.
Figure 3:
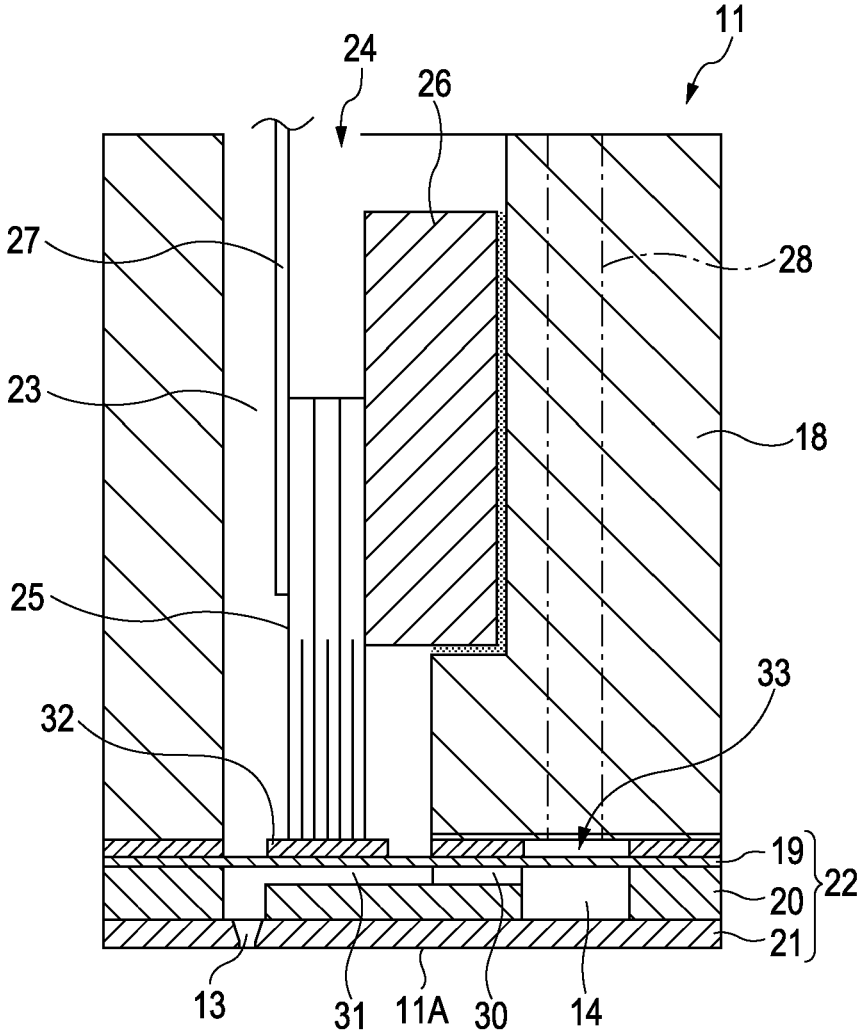
FIG. 3 is a cross-sectional view illustrating a configuration of the recording head according to the first embodiment of the invention.

FIG. 2 is a view illustrating a recording head 11 viewed from a side of an ejection plane 11A thereof according to the first embodiment of the invention. FIG. 3 is a cross-sectional view illustrating a configuration of the recording head 11 according to the first embodiment of the invention.

As shown in the drawings, an XYZ rectangular coordinate system is set. Positional relationships of members are described with reference to the XYZ rectangular coordinate system in some case. In such case, a transportation direction of a recording medium M is referred to as an X direction, a transportation plane width direction perpendicular to the transportation direction is referred to as a Y direction, and a height direction (vertical direction) perpendicular to the X direction and the Y direction is referred to as the Z direction.

The ink jet printer PRT has a configuration in which a recording process of printing predetermined pieces of information or images onto the recording medium (medium) M is performed by ejecting ink droplets (fluid). For example, a recording paper, a plastic, a glass substrate, or the like is used as the recording medium M. As shown in FIG. 1, the ink jet printer PRT includes an ink ejection mechanism IJ, a transportation mechanism CR, a maintenance mechanism MN, and a controller CONT. The ink ejection mechanism IJ includes the recording head (fluid ejecting head) 11 which ejects ink. The transportation mechanism CR transports the recording medium M. The maintenance mechanism MN maintains the recording head 11 in an excellent condition. The controller CONT has a computer system for controlling operations of each of the above components overall.

The ink ejection mechanism IJ includes the recording head 11 which ejects ink droplets (fluid) onto the recording medium M and an ink supply portion 12 which supplies ink to the recording head 11. As ink used in the embodiment, liquid-form ink of which essential ingredients are dye or pigment and a solvent dissolving or dispersing the dye or the pigment and to which various types of additives are added as needed is employed.

The recording head 11 according to the embodiment has common ink chambers 14 (14Y, 14M, 14C, 14B) which correspond to color tones of yellow (Ye), magenta (Ma), cyan (Cy) and black (Bk), respectively. Further, the recording head 11 has a configuration in which ink corresponding to each color is ejected from each of nozzles 13. Each of the nozzles 13 communicates to each of the common ink chambers 14 in a correspondence manner. Note that the recording head 11 is movable in the Z direction in a head movement device (not shown).

The ink supply portion 12 has ink tanks 12 (12Y, 12M, 12C, 12K) storing inks of the above four colors. The ink supply portion 12 also has an ink supply pump (not shown) so as to supply inks to each common ink chamber 14 from each ink tank 12. At this time, inks are supplied such that color tones of the inks correspond to those of the common ink chambers.

As shown in FIG. 2, the recording head 11 is a line type recording head having a nozzle formation region 15. The nozzle formation region 15 is provided over the width of the recording medium M of which size is maximum in a range that the ink jet printer PRT covers (maximum recording medium width W). The nozzle formation region 15 has nozzle formation regions 15Y, 15M, 15C, 15K each of which corresponds to ink of each of the above four colors. The nozzles 13 constitute a nozzle row L in which a plurality of nozzles are arranged in the Y direction so as to correspond to each of the nozzle formation regions 15. The ejection plane 11A on which the plurality of nozzles 13 are formed is arranged in the −Z direction side.

As shown in FIG. 3, the recording head 11 includes a head main body 18, a flow path formation unit 22 connected to the head main body 18. The flow path formation unit 22 includes a vibration plate 19, a flow path substrate 20 and a nozzle substrate 21 and forms the common ink chamber 14, an ink supply port 30 and a pressure chamber 31. In addition, the flow path formation unit 22 includes an island portion 32 functioning as a diaphragm portion and a compliance portion 33 absorbing pressure change in the common ink chamber 14. An accommodation space 23 which accommodates a fixing member 26 and a driving unit 24 and an internal flow path 28 which guides ink to the flow path unit 22 are formed in the head main body 18.

With the recording head 11 having the above configuration, when a driving signal is input to the driving unit 24 through a cable 27, a piezoelectric device 25 contracts. This causes the vibration plate 19 to be deformed (moved) in the direction adjacent to a cavity and in the direction separated from the cavity. Therefore, a volume of the pressure chamber 31 changes so as to change the pressure in the pressure chamber 31 containing ink. Ink is ejected from the nozzle 13 by the change in the pressure in the pressure chamber 31.

Referring to FIG. 1 again, the transportation mechanism CR has a sheet feeding roller 35, a discharge roller 36, and the like. The sheet feeding roller 35 and the discharge roller 36 are rotated and driven by a motor mechanism (not shown). The transportation mechanism CR has a configuration in which the recording medium M is transported along a transportation plane MR in conjunction with the ejection operation of the ink droplets by the ink ejection mechanism IJ.

Next, a configuration of the maintenance mechanism MN is described with reference to FIGS. 4 and 5.

Figure 4:
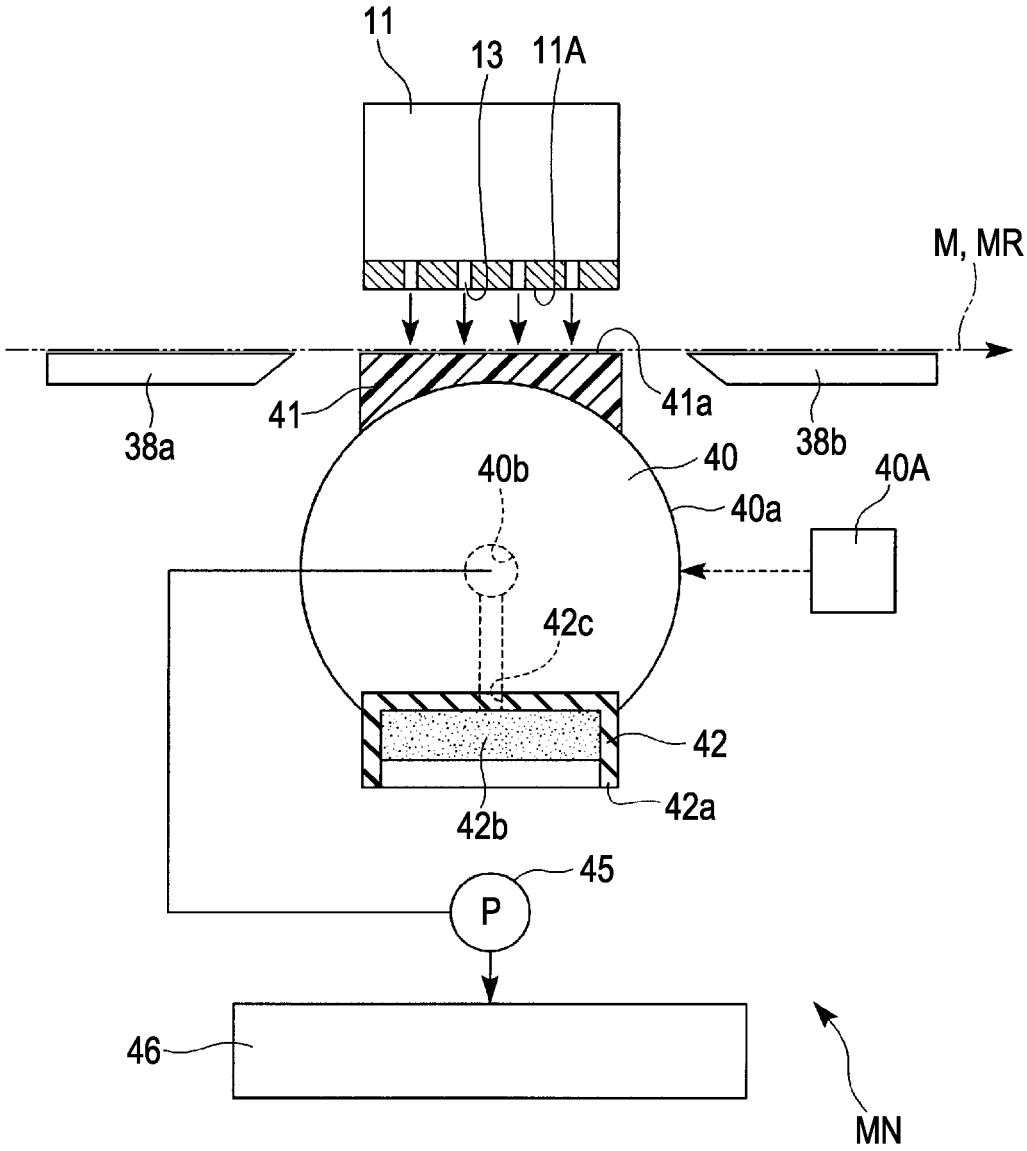
FIG. 4 is a view illustrating a configuration of a maintenance mechanism according to the first embodiment of the invention.
Figure 5:
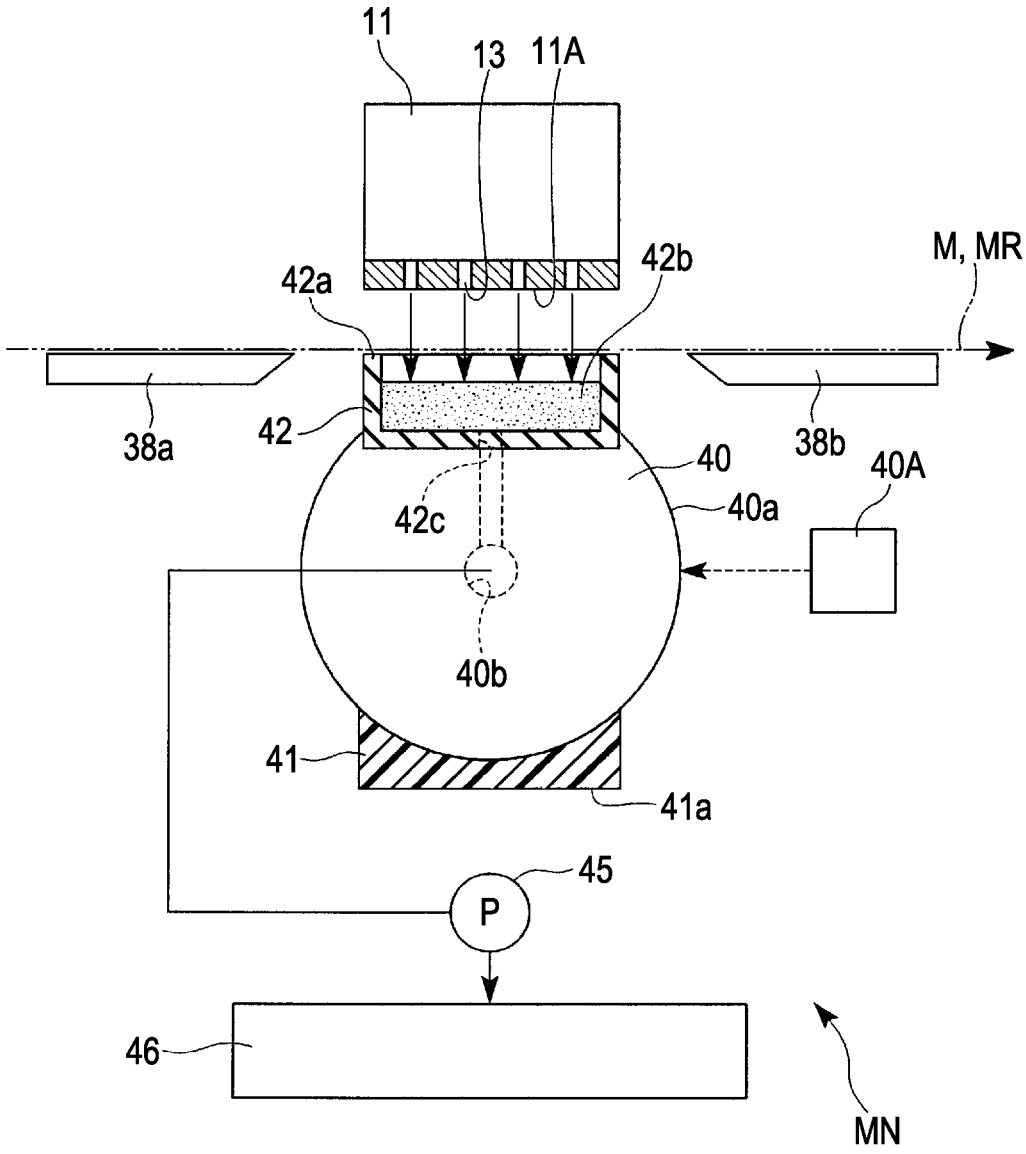
FIG. 5 is a view illustrating another configuration of the maintenance mechanism according to the first embodiment of the invention.

FIGS. 4 and 5 are views illustrating a configuration of the maintenance mechanism MN according to the first embodiment of the invention. FIG. 4 illustrates the maintenance mechanism MN at the time of a recording process. FIG. 5 illustrates the maintenance mechanism MN at the time of flushing.

The maintenance mechanism MN has a rotatable body (posture change device, second posture change device) 40, a platen member 41, a cap member (fluid reception member) 42, a suction pump (suction device, second suction device, third suction device) 45, and an ink disposal tank 46. The rotatable body 40 is rotated and driven, the platen member 41 is provided at an outer circumferential portion 40*a* of the rotatable body 40, the suction pump 45 sucks ink in the cap member 42 and the ink disposal tank 46 stores ink sucked by the suction pump 45.

The rotatable body 40 is provided at a position opposed to the ejection plane 11A of the recording head 11 and is rotated and driven around an axis extending in the Y direction which is perpendicular to the ejection direction of ink. The rotatable body 40 is driven by a rotation driving apparatus 40A and rotatable in the clockwise and counterclockwise directions in FIG. 4. Further, an encoder which detects a rotation angle of the rotatable body 40 is provided on the rotatable body 40. The detection result thereof is output to the controller CONT so as to control a posture of the rotatable body 40.

The platen member 41 is a medium supporting portion which supports the recording medium M at a position opposed to the recording head 11. The platen member 41 has a supporting plane 41*a* which supports the recording medium M. The supporting plane 41*a* constitutes a part of the transportation plane MR together with a platen 38*a* and a platen 38*b* (see FIG. 4). The platen member 41 is formed such that the supporting plane 41*a* covers a region corresponding to the nozzle formation region 15 of the recording head 11.

The cap member 42 is a tray-shaped member which caps the ejection plane 11A of the recording head 11. A rip portion 42*a* constituting an opening edge of the cap member 42 is formed of an elastic member such as a rubber member and is capable of abutting against the ejection plane 11A so as to surround the plurality of nozzles 13. The cap member 42 is also a portion for receiving ink ejected when flushing operation is performed (see, FIG. 5). Note that in the flushing operation, ink of which viscosity has increased in the nozzles 13 is ejected. The cap member 42 has an ink absorbent 42*b* in a tray. An outlet port 42*c* communicating to an ink discharge hole 40*b* formed on the rotatable body 40 is provided at a center of the bottom of the cap member 42.

The suction pump 45 is provided between the ink discharge hole 40*b* and the ink disposal tank 46 and performs a suction operation through the outlet port 42*c* of the cap member 42. The ink disposal tank 46 stores ink which is flown into by the suction operation. The ink disposal tank 46 is detachably attached to the apparatus main body and the ink stored in the ink disposal tank is periodically disposed.

The ink jet printer PRT having the above configuration drives the maintenance mechanism MN so as to periodically perform the maintenance process on the recording head 11 in order to maintain or recover an excellent ejection state of the recording head 11. As the maintenance process, an ink suction process in which ink increased in viscosity is forcibly sucked from the nozzles of the recording head 11 and a flushing process in which ink increased in viscosity is pre-ejected and removed by driving the recording head 11 are included.

In the ink suction process, the rotatable body 40 is driven so as to make the cap member 42 and the recording head 11 be opposed to each other in the Z direction, at first. Subsequently, the recording head 11 is moved in the −Z direction so as to make the ejection plane 11A close contact with the rip portion 42*a*. Therefore, a sealed chamber is formed between the recording head 11 and the cap member 42. Thereafter, the suction pump 45 is driven so that the sealed chamber is made in a negative pressure state. Then, ink increased in viscosity, adhered contaminants and the like are sucked from each nozzle 13 so as to adjust the meniscus. This makes it possible to recover an ejection characteristic of the recording head 11.

In the flushing process, as shown in FIG. 5, the rotatable body 40 is driven so as to make the cap member 42 and the recording head 11 be opposed to each other in the Z direction, at first. Subsequently, the recording head 11 is driven and ink increased in viscosity is pre-ejected onto the cap member 42 opposed to the recording head 11 so as to adjust the meniscus. This makes it possible to recover the ejection characteristic of the recording head 11.

It is to be noted that in the flushing process, ink stored in the cap member 42 is disposed in the ink disposal tank 46 by driving the suction pump 45. If the ink disposal is insufficient, ink remains in the cap member 42. Then, the remaining ink is increased in viscosity and solidified over time. This results in that the ink is firmly fixed in the cap member 42. This causes problems such as a capping failure and insufficient suction.

The ink jet printer PRT according to the embodiment reduces ink remaining in the cap member 42 by performing a characteristic liquid disposal process which will be described below with reference to FIGS. 6A to 6C.

Figure 6A:
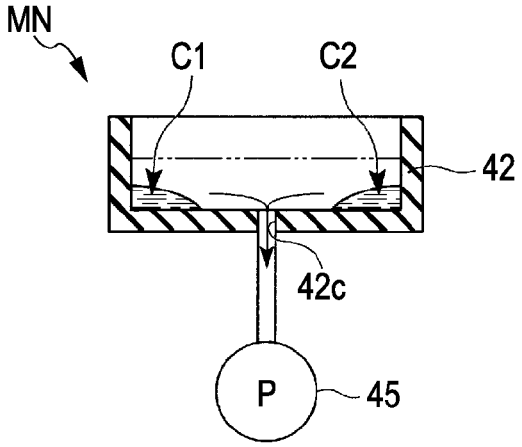
FIGS. 6A to 6C are views for explaining operations of the maintenance mechanism at the time of a liquid disposal process according to the first embodiment of the invention.
Figure 6B:
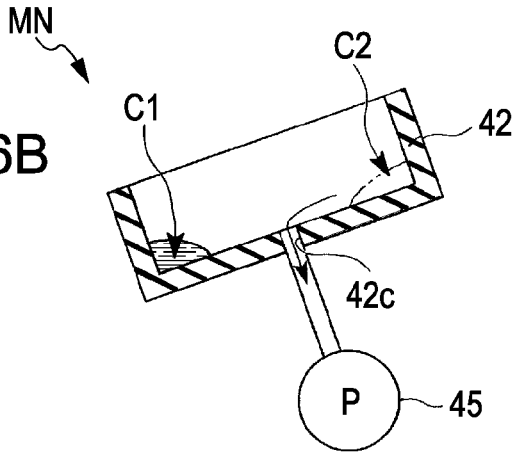
Figure 6C:
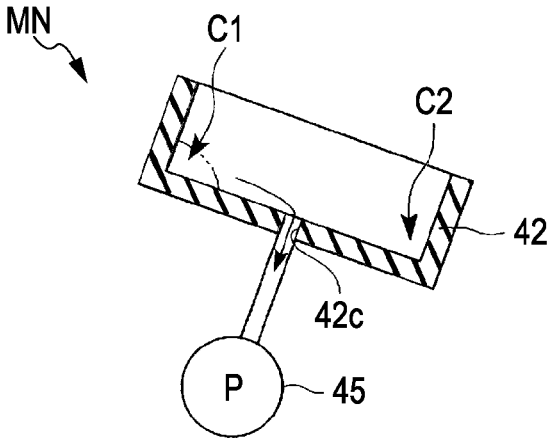

FIGS. 6A to 6C are views for explaining operations of the maintenance mechanism MN at the time of the liquid disposal process according to the first embodiment of the invention. It is noted that only a main portion of the maintenance mechanism MN is shown in order to improve visibility as shown in FIGS. 6A to 6C.

In the liquid disposal process, at first, ink in the cap member 42 is sucked while a posture for receiving ink flushed (predetermined posture) is kept so as to dispose most ink in the cap member 42 (pre-suction process), as shown in FIG. 6A.

The posture of the cap member 42 at the time of receiving ink flushed is in a horizontal state because the cap member 42 is opposed to the recording head 11. The controller CONT drives the suction pump 45 in this state. Ink in the cap member 42 is flown out from the outlet port 42*c* provided at the bottom of the cap member 42 by driving the suction pump 45 so that the liquid surface is gradually lowered. However, ink remains in corner portions C1, C2 and the like of the cap member 42 because the ink has a predetermined viscosity. Therefore, ink is left at positions where ink cannot be completely sucked.

In the liquid disposal process, next, the posture of the cap member 42 is changed to an inclined posture which is a posture inclined with respect to the posture for receiving ink flushed (posture change process), as shown in FIG. 6B. Then, ink in the cap member 42 in the inclined posture is sucked (suction process).

In the posture change process, the controller CONT rotates and drives the rotatable body 40 in the counterclockwise direction so as to change the posture of the cap member 42 to the inclined posture which is a posture inclined with respect to the horizontal surface. At this time, an inclined angle of the cap member 42 in this inclined posture is set to an appropriate angle in a range where the angle is larger than 0° and smaller than 90° with respect to the horizontal surface. Further, the angle is set in consideration of a viscosity of ink and a shape of the cap member 42 such that ink in the cap member 42 can move and diffuse.

With the posture change process, the posture of the cap member 42 becomes a posture where the corner portion C1 is on a lower side and the corner portion C2 is on an upper side. Therefore, ink remaining in the corner portion C2 on the upper side moves along the inclined bottom and diffuses to the lower side from the corner portion C2 due to own weight of ink. The controller CONT drives the suction pump 45 in this state. Ink remaining in the corner portion C2 is sucked and removed from the outlet port 42*c* by driving the suction pump 45.

Subsequently in the liquid disposal process, the posture of the cap member 42 is changed to a second inclined posture which is a posture inclined to the side opposite to the above inclined posture with respect to a posture for receiving ink flushed (second posture change process), as shown in FIG. 6C. Then, ink in the cap member 42 in the second inclined posture is sucked (second suction process).

In the second posture change process, the controller CONT rotates and drives the rotatable body 40 in the clockwise direction so as to change the posture of the cap member 42 to the second inclined posture which is a posture inclined to the direction opposite to the direction of the above inclined posture with respect to the horizontal surface. At this time, an inclined angle of the cap member 42 in this second inclined posture is set to an appropriate angle in a range where the angle is larger than 0° and smaller than 90° with respect to the horizontal surface. Further, the angle is set in consideration of a viscosity of ink and a shape of the cap member 42 such that ink in the cap member 42 can move and diffuse. Most ink is sucked and removed and the remaining amount of ink is reduced till the above suction process. Therefore, the second inclined angle is desirably set such that the cap member 42 is sharply inclined with respect to the horizontal surface in comparison with the first inclined angle.

With the second posture change process, the posture of the cap member 42 corresponds to a posture where the corner portion C1 is on an upper side and the corner portion C2 is on a lower side. Ink remaining in the corner portion C1 on the upper side moves along the inclined bottom and diffuses to the lower side from the corner portion C1 due to own weight of ink. The controller CONT drives the suction pump 45 in this state. Ink remaining in the corner portion C1 is sucked and removed from the outlet port 42*c* by driving the suction pump 45.

With the above processes experienced, ink in the cap member 42 which has received ink flushed is suitably removed. This makes it possible to realize a maintenance-free system for a long period of time without causing problems such as capping failure and insufficient suction.

Therefore, according to the above-described embodiment, a maintenance method for the ink jet printer PRT having the recording head 11 which ejects ink and the cap member 42 for receiving the ink in a predetermined posture is employed. The maintenance method includes a posture change process where a posture of the cap member 42 is changed to an inclined posture which is a posture inclined with respect to the predetermined posture, and a suction process where ink in the cap member 42 in the inclined posture is sucked after the posture change process. With this method, ink at positions where ink cannot be completely sucked in a posture for receiving ink flushed, for example, ink trapped at corners of the cap member 42 moves and diffuses due to own weight of ink so as to be sucked from the positions. This makes it possible to reduce the remaining ink.

Further, according to the above-described embodiment, the method including a second posture change process after the above suction process and a second suction process after the second posture change process is employed. In the second posture change process, the posture of the cap member 42 is changed to the second inclined posture which is a posture inclined to the side opposite to the above inclined posture with respect to the predetermined posture. In the second suction process, ink in the cap member 42 in the second inclined posture is sucked. With this method, ink at positions where ink cannot be completely sucked in the first inclined posture, for example, ink trapped in the corner portion C1 on the inclined side is moved and diffused so as to be sucked from the positions. This makes it possible to further reduce the remaining ink.

In the embodiment, the method including a pre-suction process before the posture change process is employed. In the pre-suction process, ink in the cap member 42 in the predetermined posture is sucked. With this method, most ink is previously sucked in a posture for receiving ink. Then, ink which has not been completely sucked in the pre-suction process is sucked by inclining the cap member 42. This makes it possible to effectively reduce the remaining ink.

Second Embodiment

Next, the second embodiment of the invention is described with reference to FIGS. 7A to 7C. Note that description of components having the configuration same as that in the first embodiment are not repeated here.

The second embodiment is different from the embodiment in the following points. At first, although the outlet port 42*c* is provided at the bottom of the cap member 42 in the above embodiment, the outlet ports 42*c* are provided on a position corresponding to the corner portion C1 and a position corresponding to the corner portion C2 in the second embodiment. Next, valves (opening and closing devices) 50 (50*c*1, 50*c*2) which make each outlet ports 42*c* (42*c*1, 42*c*2) be in an open state or closing state are provided in the second embodiment.

Figure 7A:
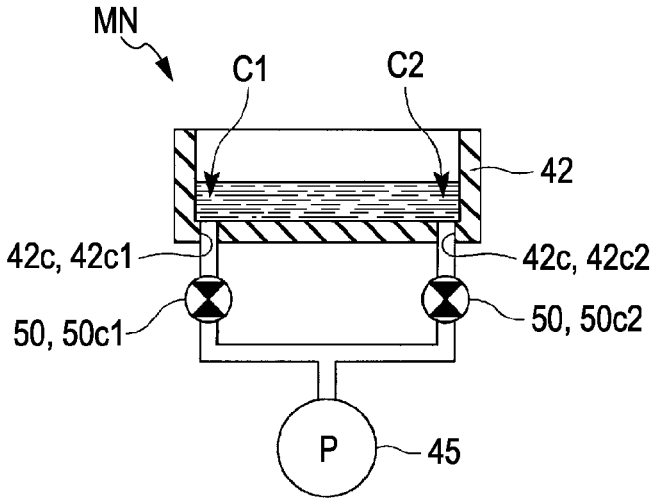
FIGS. 7A to 7C are views for explaining operations of the maintenance mechanism at the time of the liquid disposal process according to a second embodiment of the invention.
Figure 7B:
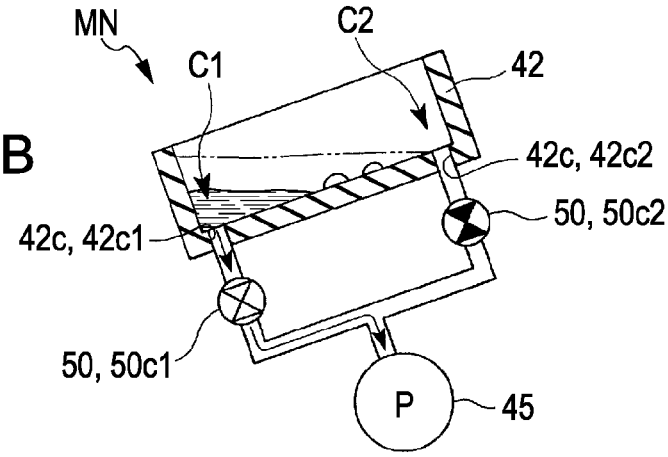
Figure 7C:
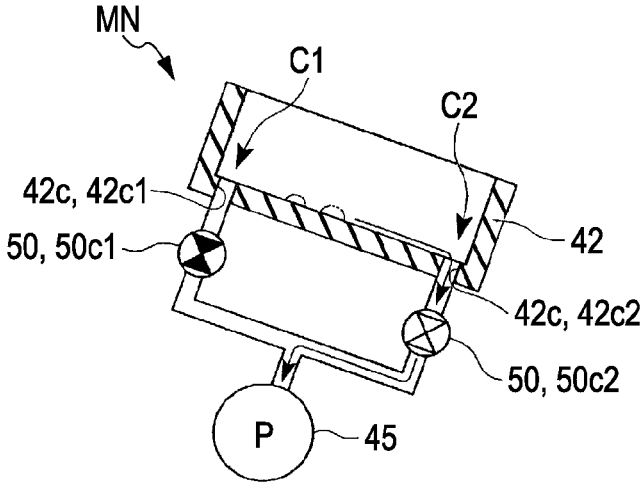

FIGS. 7A to 7C are views for explaining operations of the maintenance mechanism MN at the time of the liquid disposal process according to the second embodiment of the invention. In FIGS. 7A to 7C, the black colored valves 50 indicates that the valves 50 are in the close state and the white colored valves 50 indicates that the valves 50 are in the open state.

As shown in FIG. 7A, the cap member 42 receives ink flushed in a horizontal posture while the valves 50*c*1, 50*c*2 are in the close state. Then, the process proceeds to a posture changing as shown in FIG. 7B without experiencing the pre-suction process in the second embodiment.

In the posture change process, the controller CONT rotates and drives the rotatable body 40 in the counterclockwise direction so as to change the posture of the cap member 42 to an inclined posture which is a posture inclined with respect to the horizontal surface. With the posture change process, the posture of the cap member 42 becomes a posture where the corner portion C1 is on a lower side and the corner portion C2 is on an upper side.

In the subsequent suction process, the controller CONT drives the valve 50*c*1 so that the outlet port 42*c*1 which is on the lower side in the inclined posture of the cap member 42 is in the close state. Then, ink is sucked from the lower position so as to effectively dispose ink. In this case, the controller CONT keeps the valve 50*c*2 in the close state so as to prevent the outside air from being flown into the cap member 42 from the outlet port 42*c*2 which is on the upper side in the inclined posture of the cap member 42. Therefore, the reduction in the suction efficiency of the suction pump 45 can be suppressed.

In the subsequent second posture change process, the controller CONT rotates and drives the rotatable body 40 in the clockwise direction so as to change the posture of the cap member 42 to a second inclined posture which is a posture inclined to the direction opposite to the direction of the above inclined posture with respect to the horizontal surface. With the second posture change process, the posture of the cap member 42 corresponds to a posture where the corner portion C1 is on an upper side and the corner portion C2 is on a lower side as shown in FIG. 7C. After the above suction process has been experienced, ink still remaining in the cap member 42 moves to the corner portion C2 side along the inclined bottom due to own weight of the ink.

In the second suction process, the controller CONT drives the valve 50*c*2 so that the outlet port 42*c*2 which is on the lower side in the second inclined posture of the cap member 42 is in the open state. Therefore, ink trapped on the corner portion C2 side is disposed. Further, the controller CONT drives the valve 50*c*1 so as to prevent the outside air from being flown into the cap member 42 from the outlet port 42*c*1 which is on the upper side in the second inclined posture of the cap member 42. Therefore, the reduction in the suction efficiency of the suction pump 45 can be suppressed.

As described above, according to the above-described second embodiment, a method in which the outlet ports 42*c*1, 42*c*2 are provided at the bottom of the cap member 42 and an opening and closing processes are included is employed. In the opening and closing processes, the outlet port 42*c* provided at a position which corresponds to a lower side is set to be in an open state and the outlet port 42*c* provided at a position which corresponds to an upper side is set to be in a close state. This method makes it possible to improve the suction efficiency and reduce the remaining ink. In addition, according to the second embodiment, since the pre-suction process is not experienced, the time taken for the liquid disposal process can be made shorter so that the time taken until the process proceeds to the recording process can be also shorter.

Third Embodiment

Next, the third embodiment of the invention is described with reference to FIGS. 8A to 8C. Note that description of components having the configuration same as that in the above embodiments are not repeated here.

Figure 8A:
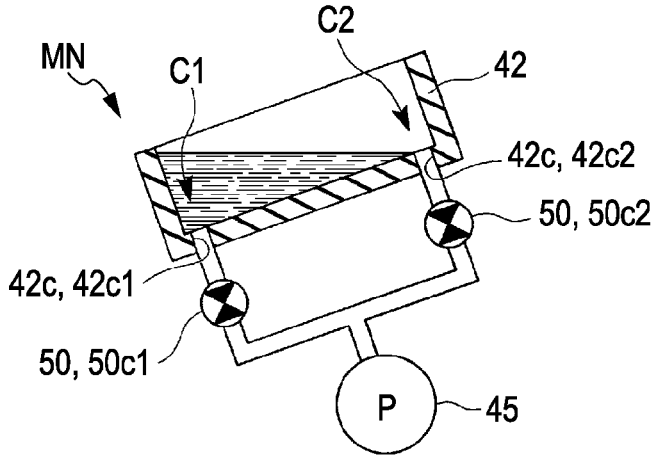
FIGS. 8A to 8C are views for explaining operations of the maintenance mechanism at the time of the liquid disposal process according to a third embodiment of the invention.
Figure 8B:
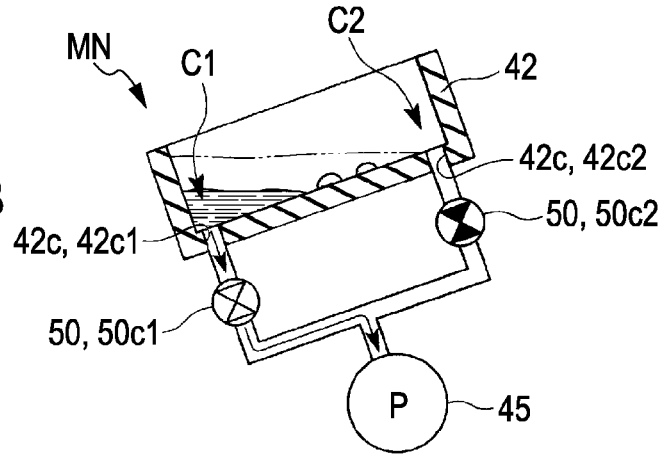
Figure 8C:
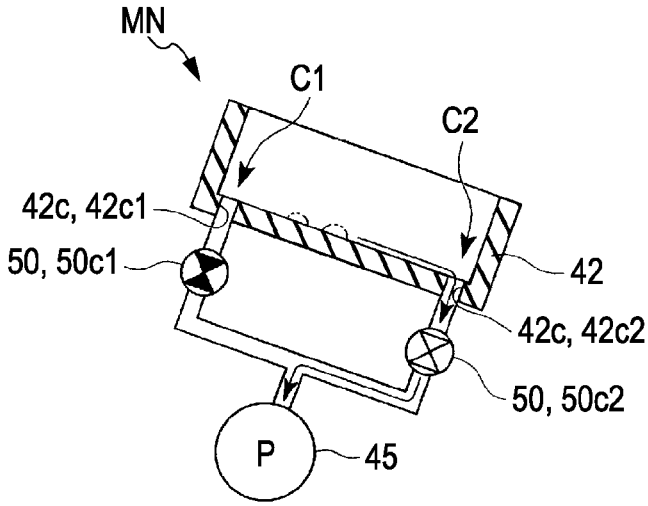

FIGS. 8A to 8C are views for explaining operations of the maintenance mechanism MN at the time of the liquid disposal process according to the third embodiment of the invention.

In the third embodiment, a mode in which the invention is applied to a large sized ink jet printer (large format printer: LFT) which can record onto a relatively large recording sheet (for example, A1 size or B1 size defined by JIS) as a recording medium is described as an example. Since the LFP is proposed in JP-A-2007-242468 previously applied by the present inventor in the past, detailed description thereof is omitted. However, it is to be noted that a posture of a cap member for receiving ink flushed from a recording head is inclined at an initial state as shown in FIG. 8A because the recording head of the LFP is provided in an inclined manner so as to correspond to an inclined recording medium transportation path.

In the third embodiment, at first, a pre-suction process in which ink in the cap member 42 is sucked while a posture for receiving ink flushed is kept and most ink is disposed, as shown in FIG. 8B. Next, as shown in FIG. 8C, the posture of the cap member 42 is changed to an inclined posture which is a posture inclined to the side opposite to the posture for receiving ink flushed (posture change process). Then, ink in the cap member 42 in the inclined posture is sucked (suction process) so as to reduce the remaining ink.

According to the third embodiment, the cap member 42 is inclined at the initial state. Therefore, remaining ink can be reduced without experiencing the second posture change process and the second suction process. This enables the time taken for the liquid disposal process to be made shorter so that the time taken until the process proceeds to the recording process can be also shorter.

Hereinbefore, although the preferred embodiments of the invention have been described with reference to the drawings, the present invention is not limited to the above embodiments. Various shapes and combinations of each component described in the above embodiments are merely examples and can be changed depending on demands for design and the like in a range without departing from a scope of the invention.

For example, as a modification of the above embodiments in terms of the combination, a process may proceed to the posture change process without experiencing the pre-suction process in the first embodiment. Further, the valves 50*c*1 and 50*c*2 may not be provided in the second embodiment and the third embodiment. In addition, the pre-suction process may be provided in the second embodiment.

For example, although the posture of the cap member is changed by the rotation of the rotatable body in the above embodiments, the invention is not limited to the configuration. For example, the posture of the cap member may be changed by arranging a plurality of movable arms or movable cylinders on the backside of the bottom of the cap member and selectively moving the plurality of movable arms and movable cylinders.

In the above embodiments, although a case where the fluid ejecting apparatus is an ink jet printer is described as an example, the fluid ejecting apparatus is not limited to the ink jet printer and may be a copying machine, a facsimile machine, or the like.

Although a case where a fluid ejecting apparatus is a fluid ejecting apparatus which ejects fluid (liquid-form compounds) such as ink is described as an example, the fluid ejecting apparatus according to the invention may be applied to a fluid ejecting apparatus which ejects and discharges fluids other than ink. The fluid which can be ejected by the fluid ejecting apparatus includes fluids, liquid-form compounds in which particles of a functioning material are dispersed or dissolved, gel-form fluid compounds, solids which can be ejected by flowing the solids as fluid, and powdery compounds (toner or the like).

Further, in the above embodiments, fluid (liquid-form compounds) ejected by the fluid ejecting apparatus is not limited to ink and may be fluid corresponding to a specific application. A predetermined device can be manufactured by providing an ejecting head which can eject fluid corresponding to the specific application on the fluid ejecting apparatus, ejecting fluid corresponding to the specific application from the ejecting head and making the fluid adhere to a predetermined material. For example, the fluid ejecting apparatus (liquid-form compound ejecting apparatus) according to the invention can be applied to a fluid ejecting apparatus which ejects fluid (liquid-form compound) obtained by dispersing (dissolving) materials such as an electrode material, a coloring material or the like in a predetermined dispersion medium (solvent). The electrode material, the coloring material or the like is used for manufacturing a liquid crystal display, an electroluminescence (EL) display and a field emission display (FED).

The fluid ejecting apparatus may be a fluid ejecting apparatus which ejects a bioorganic compound used in manufacturing a bio chip or a fluid ejecting apparatus which ejects fluid as a specimen used as a precision pipette.

Further, additional examples are a fluid ejecting apparatus which ejects lubricants onto a pinpoint of a precision instrument such as a clock or a camera, a fluid ejecting apparatus which ejects transparent resin solutions such as an ultraviolet-curing resin onto a substrate for the purpose of forming a micro semi-spherical lens (optical lens) used in an optical communication element or the like, a fluid ejecting apparatus which ejects an acid or alkali etchant solution for etching a substrate, or the like, a fluid ejecting apparatus which ejects a gel, a toner jet type recording apparatus which ejects solids including a powdery compound such as a toner. The invention can be applied to any one type of the fluid ejecting apparatuses.

The entire disclosure of Japanese Patent Application No. 2009-120230, filed May 18, 2009 is expressly incorporated by reference herein.

What is claimed is:

1. A liquid ejecting apparatus having a fluid ejecting head which ejects fluid and a fluid reception member which receives the fluid in a predetermined posture, comprising:

a posture change device which rotates to change a posture of the fluid reception member to an inclined posture which is a posture inclined with respect to the predetermined posture;

a first outlet port which is arranged at a bottom end of the fluid reception member in a direction rotating the fluid reception member;

a second outlet port which is arranged at a bottom end of the fluid reception member on an opposite side with respect to the first outlet port;

a suction device which sucks fluid in the fluid reception member in the inclined posture after changing the posture to the inclined posture; and wherein the posture change device rotates the fluid reception member to change the posture of the fluid reception member to a second inclined posture which is a posture inclined to the side opposite to the inclined posture with respect to the predetermined posture after the sucking of the fluid; and the suction device sucks fluid in the fluid reception member in the second inclined posture after changing the posture to the second inclined posture.

2. The liquid ejecting apparatus of claim 1, further comprising a first valve which is configured to open and close the first outlet port, and a second valve which is configured to open and close the second outlet port provided in the fluid reception member.

3. The liquid ejecting apparatus of claim 2, wherein the first valve is closed and above the second valve in the inclined posture and wherein the second valve is closed and above the first valve in the second inclined posture.

4. The liquid ejecting apparatus of claim 1, wherein the fluid reception member comprises a tray having an absorbent material disposed on a bottom of the tray.

* * * * *